US007021338B2

(12) United States Patent
Berry, Jr.

(10) Patent No.: US 7,021,338 B2
(45) Date of Patent: Apr. 4, 2006

(54) SEPARATED SANITARY AND STORM SEWER SYSTEM

(76) Inventor: E. Wynn Berry, Jr., 1868 Carsons Cove, Commerce, MI (US) 48390

( * ) Notice: Subject to any disclaimer, the term of this patent is extended or adjusted under 35 U.S.C. 154(b) by 61 days.

(21) Appl. No.: 10/790,471

(22) Filed: Mar. 1, 2004

(65) Prior Publication Data

US 2004/0163702 A1 Aug. 26, 2004

Related U.S. Application Data

(63) Continuation-in-part of application No. 10/247,430, filed on Sep. 19, 2002, now Pat. No. 6,698,442.

(60) Provisional application No. 60/401,714, filed on Aug. 7, 2002.

(51) Int. Cl.
*F16L 55/00* (2006.01)

(52) U.S. Cl. ..... 138/108; 138/116; 405/184.5

(58) Field of Classification Search ..... 138/98, 138/112, 113, 116, 108; 405/36, 184.4, 184.5
See application file for complete search history.

(56) References Cited

U.S. PATENT DOCUMENTS

| | | | | |
|---|---|---|---|---|
| 384,860 | A * | 6/1888 | Meehan | 138/108 |
| 2,151,206 | A * | 3/1939 | Hawthorn | 138/111 |
| 3,366,339 | A | 1/1968 | Fair | |
| 3,525,685 | A * | 8/1970 | Edwards | 210/620 |
| 3,756,266 | A | 9/1973 | Artz | |
| 3,863,679 | A * | 2/1975 | Young | 138/106 |
| 4,373,838 | A | 2/1983 | Foreman et al. | |
| 4,440,154 | A * | 4/1984 | Bellows | 126/694 |
| 4,806,705 | A * | 2/1989 | Chen | 174/135 |
| 5,018,260 | A * | 5/1991 | Ziu | 24/555 |
| 5,083,885 | A | 1/1992 | Ushitora et al. | |
| 5,161,911 | A | 11/1992 | Regan | |
| 5,480,260 | A | 1/1996 | Shattuck et al. | |
| 5,575,304 | A | 11/1996 | Hassett | |
| 5,890,837 | A | 4/1999 | Wells | |
| 6,001,212 | A | 12/1999 | Polivka et al. | |
| 6,311,730 | B1 * | 11/2001 | Penza | 138/98 |
| 6,318,395 | B1 | 11/2001 | Anderson et al. | |
| 6,406,216 | B1 | 6/2002 | Raasch | |
| 6,463,960 | B1 * | 10/2002 | Madhani et al. | 138/98 |
| 6,467,507 | B1 * | 10/2002 | Engle | 138/112 |
| 6,604,549 | B1 * | 8/2003 | Gauthier et al. | 138/108 |
| 6,698,442 | B1 * | 3/2004 | Berry, Jr. | 137/1 |
| 6,786,677 | B1 * | 9/2004 | Finzel et al. | 405/183.5 |

(Continued)

OTHER PUBLICATIONS

McPherson, M.B., "*ASCE Combined Sewer Separation Project Progress*", Oct. 16, 1967, ASCE National Meeting on Water Resources Engineering, pp 1-21, New York NY.

(Continued)

*Primary Examiner*—James Hook
(74) *Attorney, Agent, or Firm*—Butzel Long

(57) ABSTRACT

An apparatus and method for improving the operation of sewer systems includes a first set of sewer lines connected to a source of other water and a second set of sewer lines of smaller diameter than the first sewer lines connected to sources of sanitary effluent, the first and second sets of lines being separately connected to a sewerage treatment plant. The second set of sewer lines can be attached to the interior surfaces of the first set of sewer lines by an adhesive material and fasteners. A liner can be provided in the first sewer lines with the second sewer lines being positioned between an exterior surface of the liner and the interior surface of second sewer lines.

18 Claims, 6 Drawing Sheets

U.S. PATENT DOCUMENTS

| | | | | |
|---|---|---|---|---|
| 2002/0170612 | A1* | 11/2002 | Penza | 138/108 |
| 2003/0034080 | A1* | 2/2003 | Second | 138/115 |
| 2004/0146362 | A1* | 7/2004 | Penza | 405/184.4 |

OTHER PUBLICATIONS

ASCE Project Staff, Greely and Hansen, Consultants, "*American Society of Civil Engineers Combined Sewer Separation Project, Milwaukee Study Area*", Dec. 1968, pp i, 1-53, Appendix A, Appendix B.

Farrell, R. Paul and Darrah, G. Grey, "*Pressure Sewers—A Proven Alternative Solution for a Variety of Small Community Sewage Disposal Challenges*", Dec. 11, 1994, American Society of Agricultural Engineers, Atlanta, Georgia.

Anderson, Greg, "*New Fiber-Optic Installation Method for Sewers Unveiled in Toronto*", Oct. 2003, Trenchless Technology, pp. 40-41.

* cited by examiner

SEPARATED SANITARY AND STORM SEWER SYSTEM

CROSS-REFERENCE TO RELATED APPLICATION

This application is a continuation-in-part of the U.S. patent application Ser. No. 10/247,430, filed Sep. 19, 2002 now U.S. Pat. No. 6,698,442, which application claims the benefit of U.S. provisional patent application Ser. No. 60/401,714, filed Aug. 7, 2002.

BACKGROUND OF THE INVENTION

The present invention relates generally to an apparatus and a method for separating sanitary effluent from storm water and/or infiltrated water in a municipal sewer system.

Municipal sewer systems include a web of pipes that convey wastewater from homes, businesses and industries and storm water from drains to treatment plants. The smallest pipes, typically twelve inches in diameter or less, are know as "collectors" that are connected to service lines running to the sanitary plumbing of buildings. The collectors are connected to "trunk lines", typically larger than twelve inches in diameter, and carrying one to ten million gallons per day. The trunk lines connect to "interceptors" that carry the wastewater to a treatment plant. The interceptors are of large diameter, often more than ten feet.

The wastewater plumbing system in a typical house, office building or manufacturing facility combines toilet effluent with other wastewater, such as from sink and bath drains, to be carried by a single service line to the collector line at the street. Hereinafter, such combined wastewater will be termed "sanitary effluent". Some municipal sewer systems combine and carry in the same pipes the sanitary effluent from buildings, storm water from outside drains and any ground water leaking into the system (infiltrated water). Other municipal systems combine and carry in the same lines sanitary effluent from buildings, infiltrated water, and water from downspouts and/or footing drains, while having a separate storm drain system, but which in any case the two systems are interconnected downstream. When the treatment plant and the associated web of pipes are built, the system is sized to process a predetermined number of gallons per unit of time, the maximum flow capacity, including a certain rainfall amount. As additional buildings are connected to the system, less of the predetermined flow capacity is available for storm water. Thus, the system becomes susceptible to rainfall amounts less than the planned certain rainfall amount causing numerous overflows into streams and lakes and backups into buildings through the service lines. Overflows also can occur in systems where the storm water is carried in a separate set of pipes. Such overflows and backups cause serious environmental and health problems.

Also, some sewer systems were designed with less capacity than is required to carry typical rainfall amounts thereby always overflowing during normal rainfalls. Typically, such systems were installed before there was much concern for the effect of the overflow on the environment.

However, no matter what the configuration of an existing sewer system, it either now has or will in the near future have flow capacity problems causing overflows, backups and leaks. Consequently, the local governments responsible for maintaining these sewer systems face enormous expenses to repair or replace the existing pipes and/or add capacity.

SUMMARY OF THE INVENTION

The present invention concerns an apparatus and method for improving the operation of sewer systems while reducing the cost of increasing system capacity. The apparatus according to the present invention includes a first set of sewer lines connected to at least one storm water drain, and/or source of infiltrated water, and/or source of sanitary effluent, and a second set of sewer lines of smaller diameter than said sewer lines of said first set connected to sources of sanitary effluent, the first and second sets of lines being separately connected to a sewerage treatment plant. The second set of sewer lines has at least a portion thereof that extends inside the first set of sewer lines and the first set of sewer lines can be an existing sanitary sewer system. The apparatus can include at least one sanitary effluent process device connected to the second set of sewer lines such as a pumping station, a grinder pump or a vacuum system to assist the flow of the sanitary effluent through the second set of sewer lines. The apparatus can provide the same flow volume in a smaller diameter pipe that is under pressure.

The method according to the present invention includes the steps of: a. providing a first set of sewer lines connected between at least one source of storm water, and/or source of infiltrated water, and/or source of sanitary effluent, and at least one sewerage treatment plant; b. providing a second set of sewer lines connected between a source of sanitary effluent and the sewerage treatment plant; and c. installing at least a portion of said second set of sewer lines in said first set of sewer lines. Step b. can include installing a sanitary effluent collector line spaced from a collector line of the first set of sewer lines and connecting a service line from the source of sanitary effluent to the sanitary effluent collector line. Step c. can include running the sanitary effluent collector line to a manhole associated with the collector line of the first set of sewer lines and connecting the sanitary effluent collector line to a portion of the second set of sewer lines installed in the first set of sewer lines. Step c. can be performed by in situ forming of pipe included in the second set of sewer lines.

A sewer system according to the present invention reduces the size of the pipe-required to carry sanitary effluent and/or increases the capa plant to treat sanitary effluent. Since the storm water and infiltrated water are separated from the sanitary effluent, they may require little or no treatment freeing plant capacity to treat the sanitary effluent. In some cases, treatment plant expansion can be delayed or eliminated.

A combined sewer pipe apparatus according to the present invention, for conveying sanitary effluent and storm water from sources to a treatment plant, includes: a larger diameter first sewer pipe adapted to carry storm water and having an interior surface; a smaller diameter second sewer pipe adapted to carry sanitary effluent and extending through the first sewer pipe adjacent the interior surface; and a fastener means attaching the second sewer pipe to the interior surface of the first sewer pipe, the fastener means including a plurality of fasteners spaced apart along a length of the second sewer pipe and engaging an exterior surface of the second sewer pipe and an adhesive material attaching the fasteners to the interior surface of the first sewer pipe. The apparatus can further include a liner extending through the first sewer pipe, the second sewer pipe being positioned between the interior surface of the first sewer pipe and an exterior surface of the liner. The second sewer pipe can be formed of an HDPE material and the fasteners formed of a suitable plastic that can be adhesively secured to the first sewer pipe.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1:
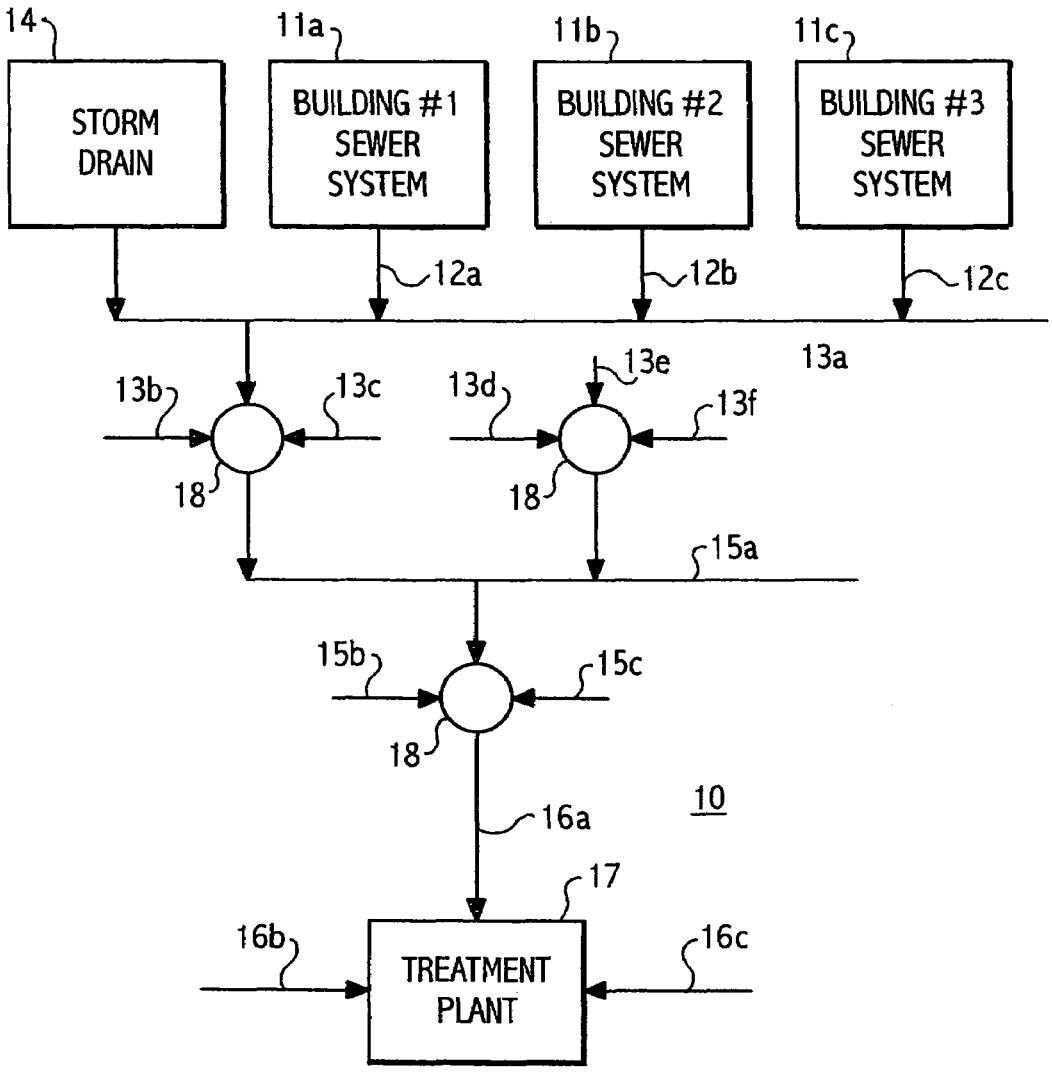
FIG. 1 (PRIOR ART)
FIG. 1 is a schematic block diagram of a typical prior art sewer system.

There is shown in FIG. 1 a typical sanitary sewer system 10 of known construction. Each one of a plurality of building sewer systems 11*a* through 11*c* collects wastewater discharged from sources in the associated building and combines that wastewater as a discharge to a sanitary sewer system. Each one of the building sewer systems 11*a* through 11*c* is connected by an associated one of a plurality of service lines 12*a* through 12*c* respectively to a collector line 13*a*. Thus, sanitary effluent from such sources as toilets, and other wastewater such as from sink drains, tub and shower drains, clothes washer drains and floor drains are combined to flow into the collector line 13*a*. Also, one or more storm drains, such as a storm drain 14, can be connected to the collector line 13*a*. The collector line 13*a* and collector lines 13*b* through 13*c* feeding from other areas are connected to a trunk line 15*a*. In a similar manner, other service lines, storm drains and collector lines are connected to trunk lines 15*b* and 15*c*. The trunk lines 15*a* through 15*c* are connected to an interceptor line 16*a* leading to a sewerage treatment plant 17 that is connected to other interceptor lines 16*b* and 16*c*. Thus, wastewater, including sanitary effluent and storm water combined, flows through the collector lines, the trunk lines and the interceptor lines in a typical sanitary sewer system 10.

While the prior art sewer system 10 is adequate for most conditions, a heavy rain entering the storm drain 14 can cause a problem by exceeding the capacity of the system to carry all of the entering water to the treatment plant 17. Overflow relief devices 18 are provided to release the wastewater from the system into drainage ditches, ponds, rivers and lakes. Although the overflow devices 18 are shown at the junction of the collector lines with the trunk line and the junction of the trunk lines with the interceptor line, the overflow devices can be connected at any suitable points in the sewerage system. A sewerage system operating near capacity may have frequent overflow problems causing contamination of swimming and boating areas with fecal matter and other wastes. Also, exceeding the system capacity causes backup through the service lines 12*a* through 12*c* typically flooding buildings with the combined sanitary effluent and storm water. The present invention seeks to solve the overflow and backup problem and increase the water treatment capacity of the sewer system by separating the sanitary effluent from the storm water as both flow through the system.

Figure 2:
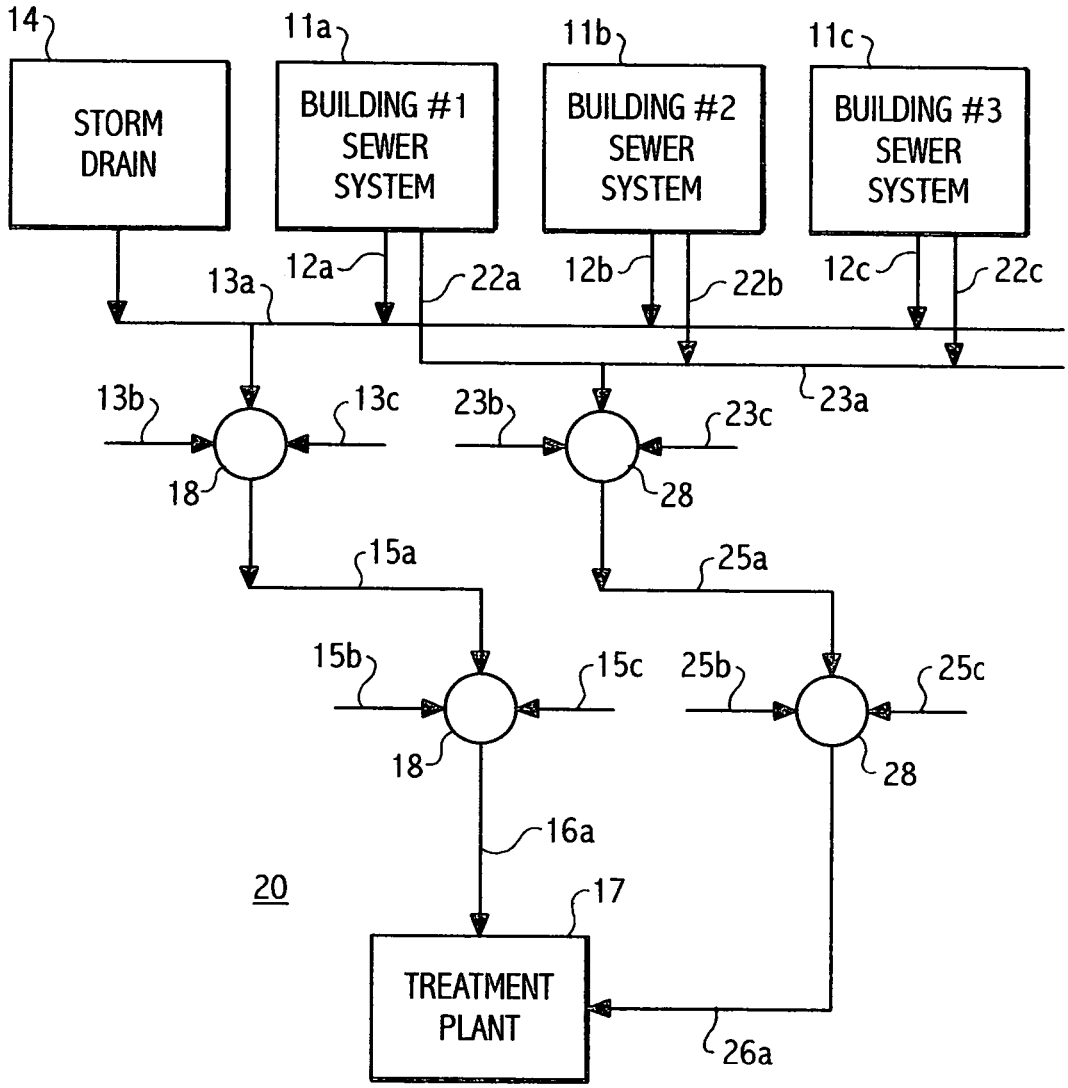
FIG. 2 is a schematic block diagram of a sewer system in accordance with a first embodiment of the present invention.

There is shown in FIG. 2 a first embodiment sanitary sewer system 20 according to the present invention wherein the sanitary effluent is completely separated from the remainder of the building wastewater. As also shown in FIG. 1, each of the building sewer systems 11*a* through 11*c* is connected by an associated one of the plurality of service lines 12*a* through 12*c* respectively to the collector line 13*a*. Thus, wastewater from such sources as sink drains, tub and shower drains, clothes washer drains and floor drains is combined to flow into the collector line 13*a*. However, the sanitary effluent from the toilets is connected to each of a plurality of sanitary effluent service lines 22*a* through 22*c* to carry the sanitary effluent to a sanitary effluent collector line 23*a* separate from the original collector line 13*a*. While new construction can be built with the required separated plumbing, existing building would require conversion. As an alternative, the new service lines 22*a* through 22*c* could be connected to and the old service lines 12*a* through 12*c* disconnected from the existing plumbing. Sanitary effluent collector lines 23*a* through 23*c* are connected to a sanitary effluent trunk line 25*a* that is connected to a sanitary effluent interceptor line 26*a* with other sanitary effluent trunk lines 25*b* and 25*c*. The sanitary effluent lines 23*a* through 23*c*, 25*a* through 25*c*, and 26*a* are interconnected at connectors 28 that do not require overflow protection. Thus, the sanitary effluent is separated from the other wastewater and will not overflow or back up into the buildings when storm water overloads the system 20.

Figure 3:
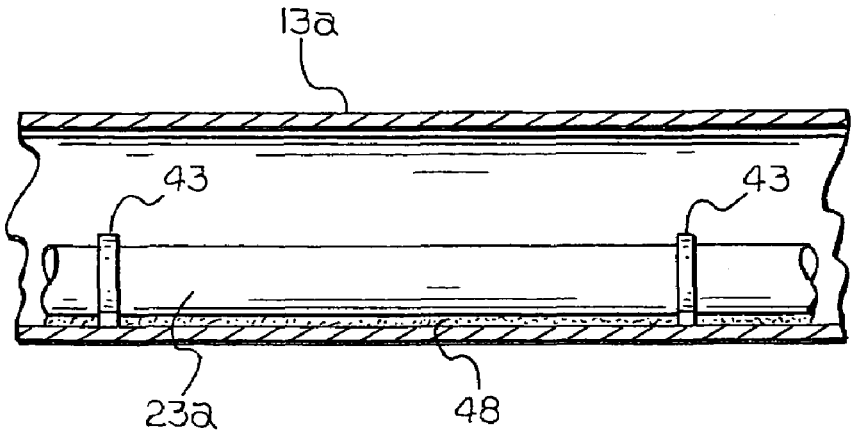
FIG. 3 is a cross-sectional view through one of the collector lines of the system shown in FIG. 2 with a nested sanitary collector line.

Although the sanitary effluent lines 22*a* through 22*c*, 23*a* through 23*c*, 25*a* through 25*c* and 26*a* could be run parallel to the other lines 12*a* through 12*c*, 13*a* through 13*c*, 15*a* through 15*c* and 16*a*, it is preferred that sanitary effluent lines run inside the other lines where possible to avoid digging separate trenches. Since existing sewer lines typically run through developed land, the installation of parallel lines can be extremely costly and very disruptive to homes and businesses. Thus, the existing sewer system 10 can be retrofitted with the new sanitary effluent lines. The sanitary effluent pipes will be of a smaller diameter than the corresponding pipes of the existing system 10 since the volume of sanitary effluent wastewater to be carried is less and the addition of pressure increases the flow rate. FIG. 3 shows the smaller diameter sanitary effluent connector line 23*a* extending inside the larger diameter collector line 13*a* that now only conveys storm water. Although the line 23*a* is shown spaced above a bottom of the outer line 13*a*, such representation is only for the purpose of clearly illustrating two separate lines and the sanitary effluent connector line 23*a* typically would rest on the bottom of the connector line 13*a*. Similarly, the sanitary effluent trunk line 25*a* would run inside the trunk line 15*a* and the sanitary effluent interceptor line 26*a* would run inside the interceptor line 16*a*.

Figure 4:
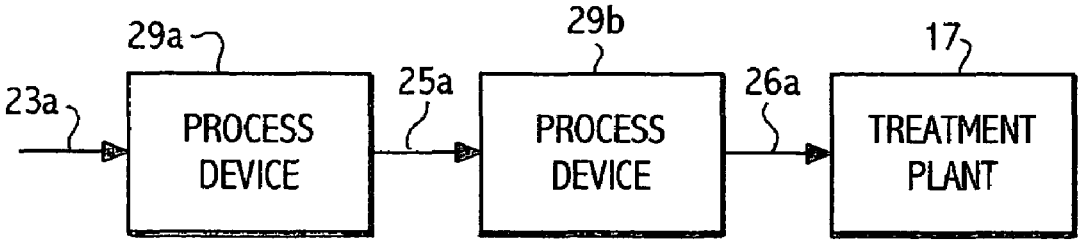
FIG. 4 is a schematic block diagram of a portion of the system shown in FIG. 2 with process devices added.

In order to properly convey the sanitary effluent wastewater to the treatment plant 17, one or more process devices may be required. For example, as shown in FIG. 4, a first process device 29*a* is connected between the collector line 23*a* and the trunk line 25*a*. A second process device 29*b* is connected between the trunk line 25*a* and the interceptor line 26*a*. The process devices 29*a* and 29*b* can be pumping stations, grinder pumps, vacuum systems, or any other type of device used to assist the flow through the lines of the sewer system 20. The process devices can be inserted at any point in the sewer system 20 and different types can be used together as required.

Since the flow through the sanitary effluent lines 23*a*, 25*a*, and 26*a* is assisted by pressure or vacuum, the flow rate is greater than in a prior art gravity system for the same diameter pipe. Thus, the cross-sectional area required to flow the same volume is reduced leaving more room in the other wastewater lines 13*a* through 13*c*, 15*a* through 15*c* and 16*a* thereby increasing the capacity to carry storm water. When there is an overflow condition, the water escaping from the overflow devices 18 is not contaminated with effluent. Also, the wastewater flowing in the lines 12*a* through 12*c*, 13*a* through 13*c*, 15*a* through 15*c* and 16*a* either does not have to be treated at the plant 17 or may require only a primary treatment. Thus, another advantage of the present invention is the freeing of significant capacity of existing plants to treat additional wastewater from the sanitary effluent lines and a reduction in the size of new treatment plants.

Figure 5:
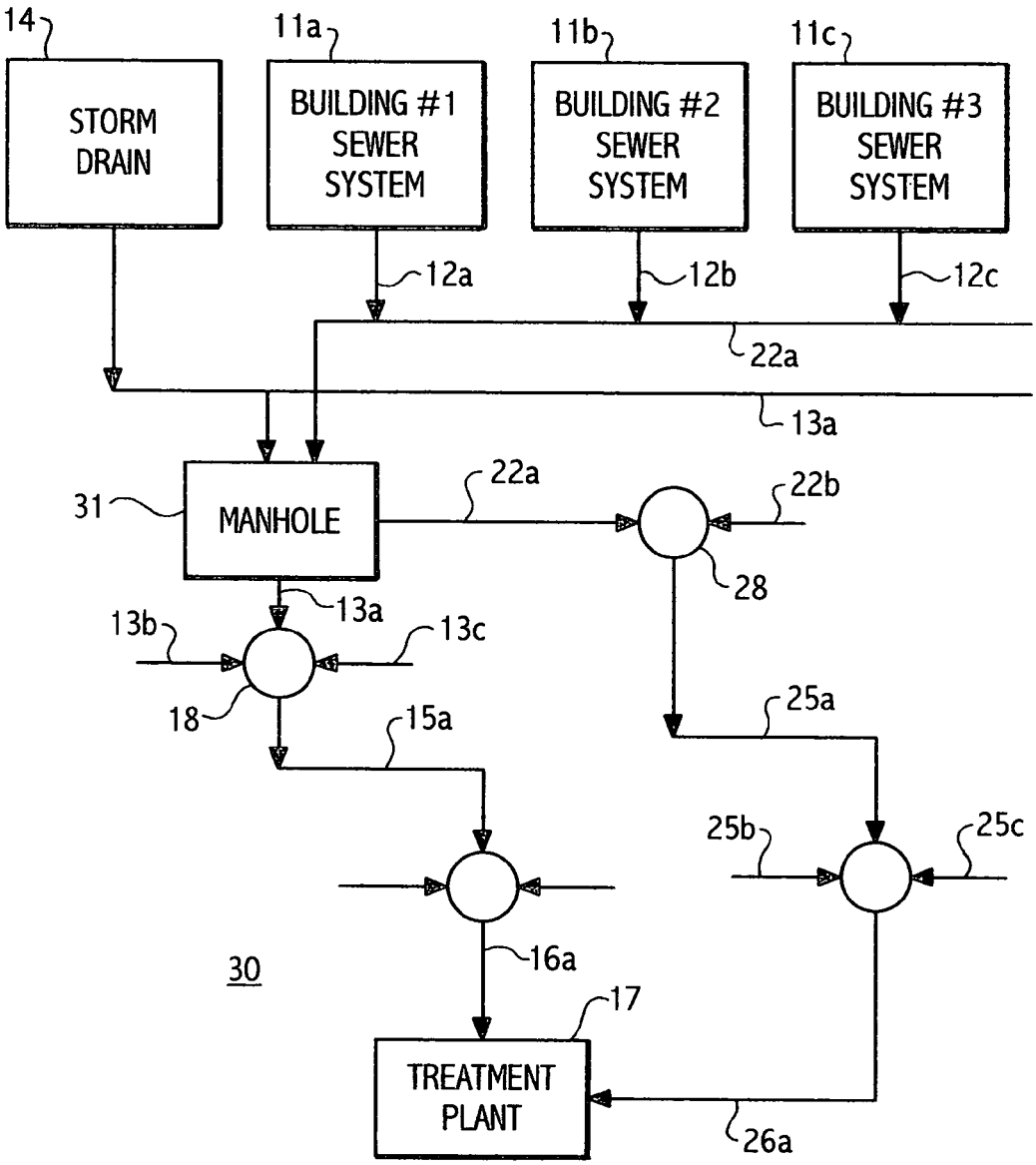
FIG. 5 is a schematic block diagram of a sewer system in accordance with a second embodiment of the present invention.

In some situations, it is desirable not to provide the sanitary effluent service lines 22*a* through 22*c* shown in FIG. 2, such as when retrofitting an existing system. There is shown in FIG. 5, a second embodiment sanitary sewer system 30 wherein the service lines 12*a* through 12*c* are connected to the sanitary effluent connector line 22*a* that runs parallel to the collector line 13*a*. Both of the collector lines 13*a* and 22*a* run into a manhole 31 wherein the line 22*a* can be inserted into the line 13*a*. From the manhole 31, the sanitary effluent lines run inside the corresponding existing sewer lines as in the system shown in FIG. 2.

The sewer system according to the present invention can be installed as a complete new system or during the repair of an existing system wherein the existing collector, trunk and interceptor lines are used as a first set of sewer lines that are connected to a source of storm water. The sanitary effluent lines according to the present invention are a second set of smaller diameter sewer lines that can be made of any suitable material such as plastic or composition materials and these lines can be placed in sections that are connected together or formed in situ during installation. A sewer system according to the present invention will prevent, or at least reduce overflows, and will eliminate backups into buildings. A sewer system according to the present invention provides a relatively inexpensive way to solve pollution problems and to modernize and expand existing sewer systems.

Figure 6:
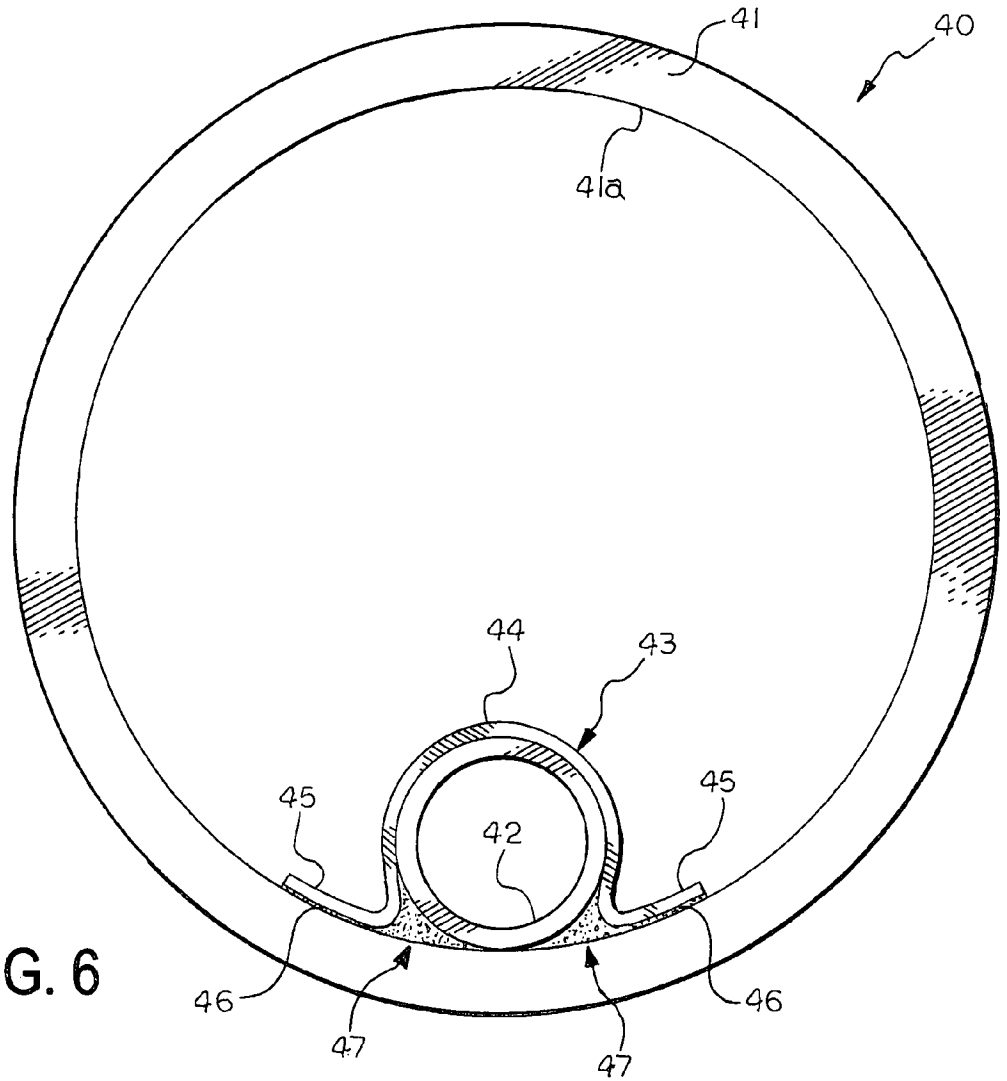
FIG. 6 is an end view of a separated sewer pipe in accordance with the present invention.

There is shown in FIG. 6 a separated sewer pipe 40 according to the present invention for use in the above-described sewer systems. An existing larger diameter combined sewer pipe 41, typically formed of a concrete or steel material, has an interior through which a new smaller diameter sanitary sewer pipe 42 has been inserted. The new pipe 42 can be formed of, for example, a suitable HDPE (high density polyethylene) plastic material. It is desirable to fix the new pipe 42 to an interior surface 41*a* of the existing outer pipe 41. A fastener 43 is utilized for this purpose and preferably is formed from a molded plastic material or other material suitable for adhesion to the outer pipe 41. The fastener 43 can be of continuous form, extending the length of the pipe 42, or provided as a plurality of fastener straps spaced apart along the longitudinal axis of the pipe 42 at suitable intervals as shown in FIG. 3 being used with the collector line 23*a*. The fastener 43 can be free or can be attached to the outer surface of the pipe 42 by any suitable means such as adhesive or ultrasonic welding.

The fastener 43 has an arcuate central portion 44 that is curved to engage a part of an outer surface of the pipe 42. Extending from either end of the central portion 44 is an end portion 45 that is shaped to engage a part of the inner surface 41*a* of the pipe 41. The end portions 45 are attached to the pipe 41 with a suitable adhesive material 46 that adheres to both concrete and plastic and is moisture resistant. The adhesive 46 also can fill spaces 47 surrounded by the facing surfaces of the pipe 41, the pipe 42 and the fastener 43. One adhesive that can be used is a 3M Scotch-Grip Industrial Adhesive 4799 available from 3M Adhesives Division in St. Paul, Minn. In the Continuous form, the fastener 43 requires slots or apertures (not shown) formed therein for introducing the adhesive 46 between the end portions 45 and the surface 41*a* and into the spaces 47.

Figure 7:
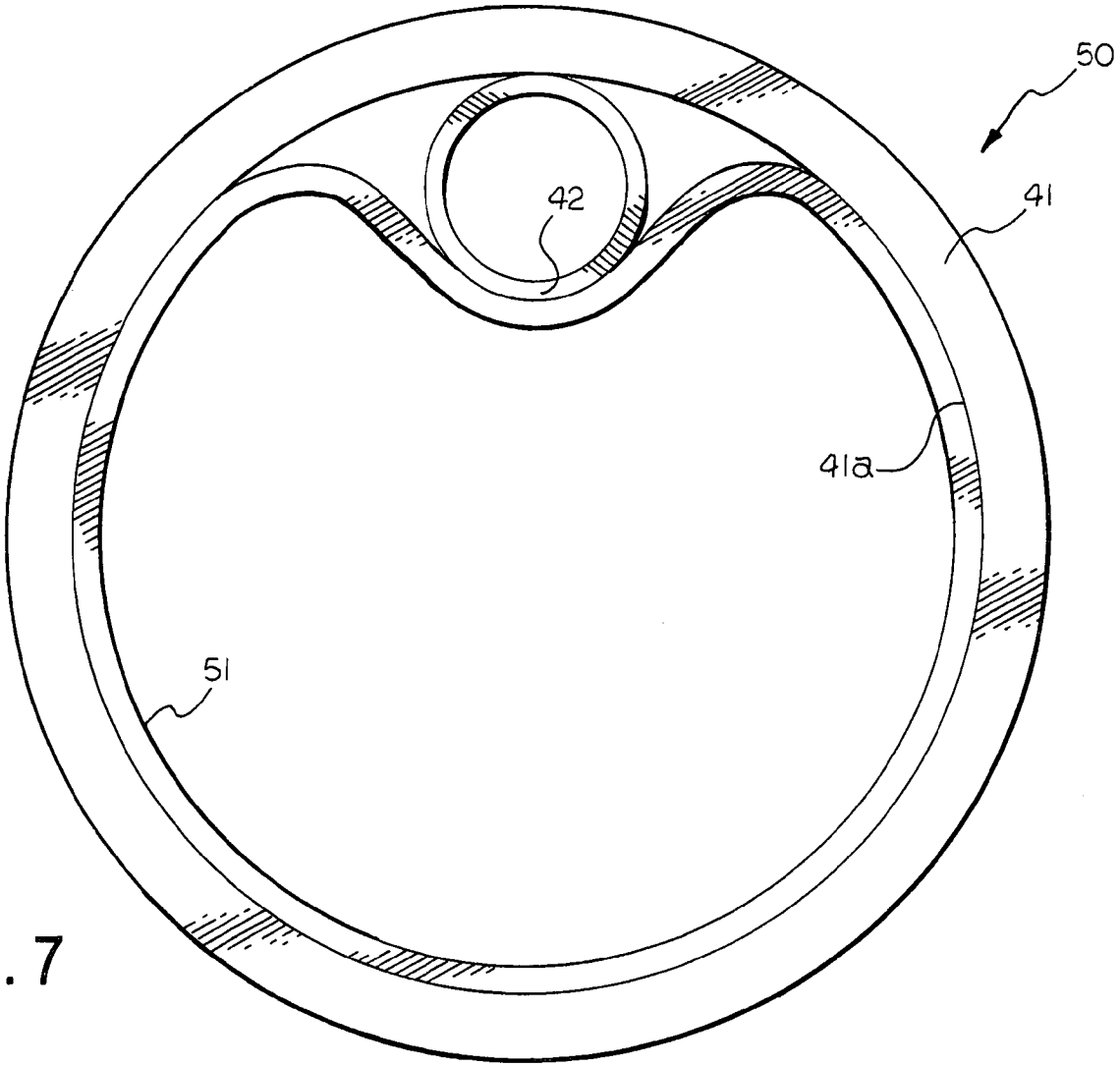
FIG. 7 is an end view of an alternate embodiment separated sewer pipe in accordance with the present invention.

Although the pipe 42 is shown in FIG. 6 as being mounted at the bottom of the interior of the pipe 41, it can be mounted at any desired point along the circumference of the inner wall 41*a*. For example, in FIG. 7, the pipe 42 is shown mounted at the top of the interior of the outer pipe 41. This mounting can be the same as is shown in FIG. 6 utilizing the hanger 43 and the adhesive material 46. However, FIG. 7 shows a separated sewer pipe 50, according to an alternate embodiment of the present invention for use in the above-described sewer systems. When the existing combined sewer pipe 41 has a rough interior surface 41*a* and/or is cracked and leaking, it may be desirable to provide a lining 51. The lining 51 can be inserted into the interior of the existing sewer pipe 41 or can be formed in situ after the new pipe 42 is installed. The lining 51 holds the pipe 42 in place and the hangers 43 and the adhesive 46 are not required.

Although the separated sewer pipes 40 and 50 have been discussed in terms of utilizing the existing combined sewer pipe 41, a new storm sewer pipe can be provided where the old pipe must be replaced or in new construction installations.

As shown in FIG. 3, the fasteners 43 can be used with a grout material or an adhesive material 48 applied along the entire length of the sanitary sewer pipe 23*a* (42). Furthermore, if the grout/adhesive material alone 48 is a sufficient fastening means, the fasteners 43 can be eliminated.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A combined sewer pipe apparatus for conveying sanitary effluent and storm water from sources to a treatment plant comprising:

a larger diameter first sewer pipe adapted to carry storm water and having an interior surface;

a smaller diameter second sewer pipe adapted to carry sanitary effluent and extending through said first sewer pipe in contact with said interior surface of said first sewer pipe; and a fastener means maintaining said second sewer pipe in contact with said interior surface of said first sewer pipe, said fastener means including one of a grout material and an adhesive material.

2. The apparatus according to claim 1 wherein said second sewer pipe is formed of an HDPE material.

3. The apparatus according to claim 1 wherein said fastener means includes a plurality of fasteners spaced along said second sewer pipe engaging an exterior surface of said second sewer pipe and being attached to said first sewer pipe.

4. The apparatus according to claim 1 wherein said fastener means includes a plurality of fasteners spaced along said second sewer pipe engaging an exterior surface of said sewer second pipe and being attached to said first sewer pipe.

5. The apparatus according to claim 4 wherein said fasteners are formed of a plastic material.

6. The apparatus according to claim 4 wherein said adhesive material attaches said fasteners to said first sewer pipe.

7. The apparatus according to claim 4 wherein facing surfaces of each of said fasteners, said first sewer pipe and said second sewer pipe form a pair of spaces with one of said grout material and said adhesive material filling said spaces.

8. The apparatus according to claim 4 wherein each of said fasteners has an arcuate central portion extending between a pair of end portions, said central portion being shaped to conform with a part of an exterior surface of said second sewer pipe and said end portions being shaped to conform to said interior surface of said first sewer pipe.

9. The apparatus according to claim 1 wherein said fastener means includes a liner extending through said first sewer pipe, said second sewer pipe being positioned between said interior surface of said first sewer pipe and an exterior surface of said liner.

10. An apparatus for separating sanitary effluent from storm water in a sewer pipe comprising:

a sanitary sewer pipe adapted to carry sanitary effluent and sized to extend inside an outer sewer pipe adapted to carry storm water and having an interior surface; and a fastener means for maintaining said sanitary sewer pipe in contact with the interior surface of the outer sewer pipe when said sanitary sewer pipe and said fastener means are inserted into the outer sewer pipe, said fastener means including one of a grout material and an adhesive material.

11. The apparatus according to claim 10 wherein said sanitary sewer pipe is formed of an HDPE material.

12. The apparatus according in claim 10 wherein said fastener means includes a plurality of fasteners spaced along said sanitary sewer pipe for engaging an exterior surface of said sanitary sewer pipe and adapted to be attached to the interior surface of the outer sewer pipe.

13. The apparatus according to claim 12 wherein said fasteners are formed of a plastic material.

14. The apparatus according to claim 12 wherein said adhesive material attaches said fasteners to the outer sewer pipe.

15. The apparatus according to claim 12 wherein each of said fasteners has an arcuate central portion extending between a pair of end portions, said central portion being shaped to conform with a part of said exterior surface of said sanitary sewer pipe and said end portions being shaped to conform to the interior surface of the outer sewer pipe.

16. A combined sewer pipe apparatus for conveying sanitary effluent and storm water from sources to a treatment plant comprising:

a larger diameter first sewer pipe adapted to carry storm water and having an interior surface;

a smaller diameter second sewer pipe adapted to carry sanitary effluent and extending through said first sewer pipe in contact with said interior surface; and a fastener means attaching said second sewer pipe to said interior surface of said first sewer pipe to maintain the contact, said fastener means including a plurality of fasteners spaced apart along a length of said second sewer pipe and engaging an exterior surface of said second sewer pipe and an adhesive material attaching said fasteners to said interior surface of said first sewer pipe.

17. The apparatus according to claim 16 including a liner extending through said first sewer pipe, said second sewer pipe being positioned between said interior surface of said first sewer pipe and an exterior surface of said liner.

18. The apparatus according to claim 17 wherein said second sewer pipe is formed of an HDPE material.

* * * * *